US007475966B2

(12) United States Patent
Fujii et al.

(10) Patent No.: US 7,475,966 B2
(45) Date of Patent: Jan. 13, 2009

(54) LIQUID DISCHARGE RECORDING HEAD AND METHOD FOR MANUFACTURING SAME

(75) Inventors: Kenji Fujii, Hiratsuka (JP); Shuji Koyama, Kawasaki (JP); Masaki Osumi, Yokosuka (JP); Jun Yamamuro, Yokohama (JP); Hiroyuki Murayama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 395 days.

(21) Appl. No.: 11/261,511

(22) Filed: Oct. 31, 2005

(65) Prior Publication Data

US 2006/0098055 A1 May 11, 2006

(30) Foreign Application Priority Data

Nov. 10, 2004 (JP) ..... 2004-326717

(51) Int. Cl.
*B41J 2/05* (2006.01)

(52) U.S. Cl. ..... 347/65

(58) Field of Classification Search ..... 347/61, 347/63, 65

See application file for complete search history.

(56) References Cited

U.S. PATENT DOCUMENTS 6,180,018 B1 1/2001 Miyagawa et al. ..... 216/27
6,290,337 B1 * 9/2001 Radke ..... 347/65
6,472,125 B1 10/2002 Koide et al.
6,929,349 B2 * 8/2005 Bell et al. ..... 347/44
2005/0248623 A1 11/2005 Komura et al. ..... 247/58
2007/0017894 A1 1/2007 Murayama et al. ..... 216/27

FOREIGN PATENT DOCUMENTS

JP 2001-287373 10/2001

OTHER PUBLICATIONS

Note: Counterpart U.S. patent also cited (see text of IDS).

* cited by examiner

*Primary Examiner*—An H Do
(74) *Attorney, Agent, or Firm*—Fitzpatrick, Cella, Harper & Scinto

(57) ABSTRACT

A liquid discharge recording head in which a nozzle plate is formed from inorganic material can be manufactured at low cost and with good through-put. In the liquid discharge recording head, a nozzle plate formed from inorganic material is stacked on a front surface of a silicon substrate including heat generating resistor members for generating energy for discharging liquid and an electric circuit for driving the heat generating resistor members. The liquid can be supplied from a liquid supply port extending through the silicon substrate to flow paths provided between the silicon substrate and the nozzle plate. Recessed portions having predetermined depths are formed in regions of the surface of the silicon substrate, where the flow paths are formed, and discharge ports are formed above the recessed portions.

7 Claims, 5 Drawing Sheets

LIQUID DISCHARGE RECORDING HEAD AND METHOD FOR MANUFACTURING SAME

BACKGROUND OF THE INVENTION

1. Field of the Invention

The present invention relates to a liquid discharge recording head (also referred to merely as "recording head" hereinafter) for forming an image on a surface of a recording medium by discharging ink or other liquid toward the recording medium and a method for manufacturing such a head. Here, the wording "form an image" means that not only any meaningful image such as a character, a figure, a symbol or the like is formed, but also a particular meaningless image such as a geometric pattern or the like is formed.

2. Related Background Art

In conventional recording heads, liquid is supplied to a plurality of flow paths formed in one surface of a substrate via liquid supply ports extending through the substrate in a thickness-wise direction, and the liquid is supplied to corresponding discharge ports via the respective flow paths. In general, the flow paths and the discharge ports are formed by patterning of a film made of organic resin material and formed on one surface of the substrate. The reason is that, although the film is required to have a thickness of several μm to several tens of μm, the organic resin material is suitable to obtain such a thick film cheaply in a mass production.

However, the organic resin material has properties such as low mechanical strength, a low glass transition point, high thermal expansion rate and high moisture absorption expansion rate, and thus, due to such properties, there arise a problem that endurance and reliability of the recording head are reduced.

However, the organic resin material has properties such as low mechanical strength, a low glass transition point, high thermal expansion rate and high moisture absorption expansion rate, and thus, due to such properties, there arises a problem that endurance and reliability of the recording head are reduced.

To cope with this, as disclosed in Japanese Patent Application Laid-Open No. 2001-287373, there have been proposed a recording head and a method for manufacturing such a head, in which flow paths and discharge ports are formed by using inorganic material. Now, the method for manufacturing the recording head disclosed in the above-mentioned Japanese Patent Application Laid-Open No. 2001-287373 will be described with reference to FIGS. 4A, 4B, 4C, 4D, 4E and 4F. First of all, as shown in FIG. 4A, a heat-insulative layer 31, a heating layer 32, a protective layer 33 and an anti-cavitation layer 34 are laminated, in order, on a surface of a silicon substrate 30. Then, as shown in FIG. 4B, a pattern layer 35 corresponding to a desired flow path configuration is laminated. Thereafter, as shown in FIG. 4C, an inorganic material layer 36 for forming flow paths and discharge ports is laminated on the pattern layer 35. Thereafter, as shown in FIG. 4D, the formed inorganic material layer 36 is flattened by CMP (chemical mechanical planarization). Then, as shown in FIG. 4E, after a water-repellent layer is formed on a surface of the flattened inorganic material layer 36, a pattern image having a desired discharge port configuration is illuminated by a femto second laser, thereby piercing the discharge ports 38. In this way, a nozzle plate 39 is formed on the silicon substrate 30. Thereafter, as shown in FIG. 4F, the silicon substrate 30 is subjected to etching from its back surface side to form liquid supply ports 40, and the flow paths 41 are formed by removing the pattern layer 35 from the formed liquid supply ports 40.

However, the manufacturing method disclosed in the above-mentioned Japanese Patent Application Laid-Open No. 2001-287373 had the following problems. That is to say, in consideration of flattening treatment in post-processing, the inorganic material layer having considerable thickness must be stacked. For example, in a case where the thickness (height) of the pattern layer is 5 μm, the inorganic material layer having a thickness of about 15 μm must be stacked. Thus, the through-put of the film forming apparatus is considerably worsened, so that the mass production is hard to be achieved unless many of expensive film forming apparatuses are provided. Further, in a case where a high density arrangement of nozzles is further developed, with the result that a gap between the pattern layers is more reduced, filling of the inorganic material into the gap is worsened. As a result, there is a great possibility of generating voids in the nozzle plate. If any void is created in the nozzle plate, the strength and reliability of the nozzle plate will be reduced. On the other hand, if any void is tried to be prevented from being created in the nozzle plate, the degree of freedom for the designing will be greatly limited. Further, the greater the thickness of the inorganic material layer, the greater inner stress, with the result that breakage is apt to be occurred in an interface between the layer and the silicon substrate. Generally, the conventional manufacturing methods are expensive and have low through-put.

SUMMARY OF THE INVENTION

The present invention is made in consideration of the above-mentioned conventional problems and an object of the present invention is to provide a method capable of manufacturing, with low cost and good through-put, a recording head in which a nozzle plate is formed from inorganic material, and a recording head manufactured by such a method.

In a liquid discharge recording head according to the present invention, a nozzle plate made of inorganic material is stacked on a front surface of a silicon substrate including a discharge energy generating element for generating energy for discharging liquid and an electric circuit for driving the discharge energy generating element, and the liquid can be supplied to a flow path provided between the silicon substrate and the nozzle plate from a liquid supply port extending through the silicon substrate; the recording head being characterized in that a recessed portion having a predetermined depth is formed in a region of the surface of the silicone substrate, where the flow path is provided, and a discharge port for discharging the liquid is formed above the recessed portion.

A method for manufacturing a liquid discharge recording head according to the present invention comprises (1) a step for forming a recessed portion having a predetermined depth in a surface of a silicon substrate, (2) a step for forming a heat-insulative layer on the surface of the silicon substrate, (3) a step for forming a heating layer capable of converting electrical energy into thermal energy on the heat-insulative layer, (4) a step for forming a protective layer for protecting the heating layer on the heating layer, (5) a step for forming a pattern layer based on a bottom surface of the recessed portion above the recessed portion, (6) a step for flattening the pattern layer, (7) a step for forming a nozzle plate layer with inorganic material on the flattened pattern layer, (8) a step for etching the nozzle plate layer to form a discharge port, (9) a step for etching the silicon substrate from its back surface side to pierce a hole reaching the pattern layer and (10) a step for removing the pattern layer through the hole.

According to the present invention, since the discharge energy generating element is formed in the recessed portion formed in the silicon substrate, a thickness of the nozzle plate is considerably reduced in comparison with conventional nozzle plates. Thus, through-put of a film forming apparatus used to form the nozzle plate is increased, thereby enhancing production efficiency. Further, in the step for forming the nozzle plate, the possibility of creating any void in the nozzle plate is reduced considerably, thereby greatly increasing strength and reliability of the nozzle plate. Further, inner stress of the nozzle plate is reduced, with the result that the possibility of generating peeling and/or breakage in an interface between the nozzle plate and the silicon substrate is greatly decreased.

DESCRIPTION OF THE PREFERRED EMBODIMENTS

Figure 1:
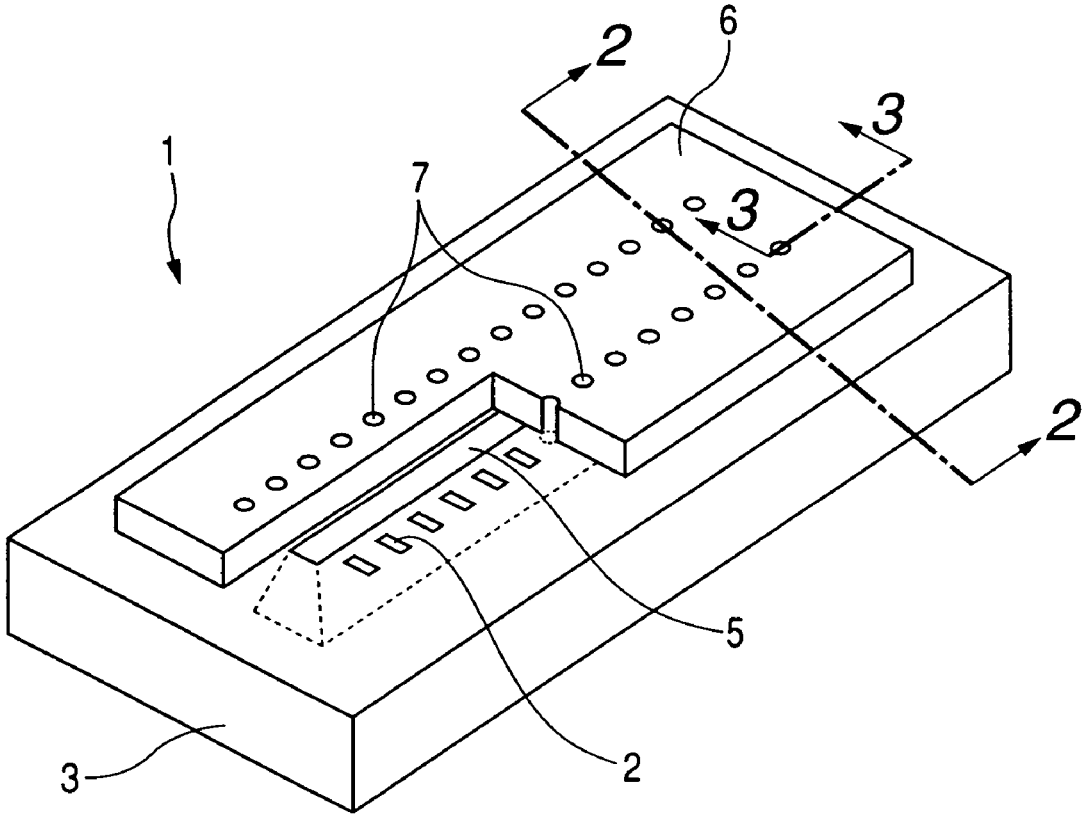
FIG. 1 is a schematic perspective view showing an example of a liquid discharge recording head of the present invention.

Now, an embodiment of a recording head according to the present invention will be explained with reference to the accompanying drawings. FIG. 1 is a schematic perspective view showing a recording head 1 according to this embodiment. The recording head 1 comprises a silicon substrate 3 on which heat generating resistant (or resistor) members 2 as discharge energy generating elements for generating energy for discharging liquid (ink) are formed in two rows with a predetermined pitch. An ink supply port 5 is elongated along a longitudinal direction of the silicon substrate 3 and is opened to the surface of the silicon substrate 3 between two rows of the heat generating resistant members. Further, on the front surface of the silicon substrate 3, discharge ports 7 opened above the respective heat generating resistant members 2 and a plurality of flow paths (not shown) for communicating the ink supply port 5 with the respective discharge port 7 are formed by a nozzle plate 6 consisting of a silicon oxide film.

In the recording head having the above-mentioned arrangement, heat generated by the heat generating resistant members 2 is applied to the ink filled in the respective flow paths through the ink supply port 5. Consequently, an ink droplet is discharged from the discharge port 7, with the result that an image is formed on a recording medium by sticking the discharged ink droplet to the recording medium.

Next, a further detailed structure of the recording head 1 according to the illustrated embodiment will be made clear, while explaining a method for manufacturing the recording head 1 according to the illustrated embodiment with reference to FIGS. 2A, 2B, 2C, 2D, 2E, 2F, 2G, 2H, 21, 2J and 2K. The manufacturing method described here is based on a technique in which required features are formed on the surface of the silicon substrate 3 by using a semi-conductor manufacturing technique. Here, sectional conditions of the recording head being manufactured are shown in a time-lapse manner in FIGS. 2A, 2B, 2C, 2D, 2E, 2F, 2G, 2H, 21, 2J and 2K. At the left sides of FIGS. 2A, 2B, 2C, 2D, 2E, 2F, 2G, 2H, 21, 2J and 2K, the sectional conditions parallel to the longitudinal direction of the silicon substrate 3 are shown, whereas, at the right side of FIGS. 2A, 2B, 2C, 2D, 2E, 2F, 2G, 2H, 21, 2J and 2K, the sectional conditions transverse to the longitudinal direction of the silicon substrate 3 are shown. Incidentally, in FIG. 1, in order to show positions of the sections shown in FIGS. 2A, 2B, 2C, 2D, 2E, 2F, 2G, 2H, 21, 2J and 2K more clearly, the positions of the sections shown at the left sides of FIGS. 2A, 2B, 2C, 2D, 2E, 2F, 2G, 2H, 21, 2J and 2K are along a line segment 3-3 and the positions of the sections shown at the right sides of FIGS. 2A, 2B, 2C, 2D, 2E, 2F, 2G, 2H, 21, 2J and 2K are along a line segment 2-2 in FIG. 1.

First of all, the silicon substrate 3 is prepared. Although crystal orientation of the silicon substrate 3 according to the illustrated embodiment is <100> face, face orientation of the silicon substrate 3 is not particularly limited, but, for example, <110> face may be used.

Figure 2A:
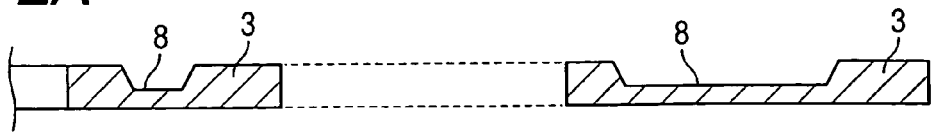
FIGS. 2A, 2B, 2C, 2D, 2E, 2F, 2G, 2H, 2I, 2J and 2K are partial sectional views showing manufacturing steps for the liquid discharge recording head of FIG. 1.

On the surface of the silicon substrate 3, plural recessed portions 8 which are elongated in a width-wise direction of the substrate 3 and which each has a predetermined depth are formed along the longitudinal direction of the substrate 3. A sectional configuration of each recessed portion 8 is as shown in FIG. 2A. The recessed portions 8 can be formed by forming a mask made of a silicon oxide film on the surface of the silicon substrate 3 and then by performing etching. As an etching method, wet etching or dry etching may be used, but, in the illustrated embodiment, the recessed portions 8 are formed by wet etching using strong alkali solution. Regarding the depth of the recessed portion 8, a value between 1 μm and 20 μm is desirable, and, in the illustrated embodiment, the depth of 5 μm is selected. Further, regarding the configuration of the recessed portion 8, either a rectangular shape or a square shape or an elliptical shape or polygonal shape may be used. In the illustrated embodiment, the rectangular shape is used as mentioned above.

Figure 2B:
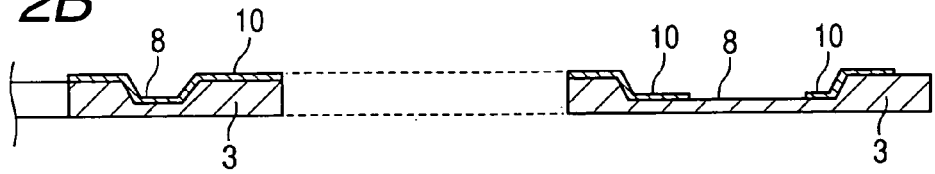

Then, as shown in FIG. 2B, silicon oxide film is film-formed as a heat-insulative layer 10 on the surface of the silicon substrate 3 in which the recessed portions 8 are formed, and predetermined patterning is performed. A thickness of the heat-insulative layer 10 is selected to 1.1 μm.

Figure 2C:
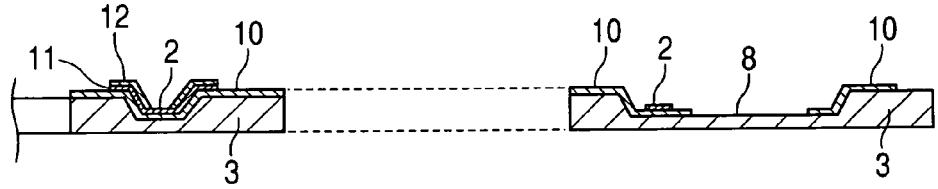

Then, a heating layer 11 and an aluminium wiring layer 12 for supplying electric current to the heating layer 11 are successively stacked on the heat-insulative layer 10 by using a sputtering device. Thereafter, as shown in FIG. 2C, a predetermined part of the aliminium wiring layer 12 is etched to form the heat generating resistant members 2. Incidentally, a thickness of the heating layer 11 is selected to 0.05 μm and a thickness of the aluminium wiring layer 12 is selected to 0.3 μm. Although steps for forming an electric control circuit for driving the heat generating resistant members 2 is not referred to here, actually, the electric control circuit is also formed. Although the heating layer 11 can be formed from material such as tantalum silicon nitride or tantalum chrome, in the illustrated embodiment, tantalum silicon nitride is selected.

Figure 2D:
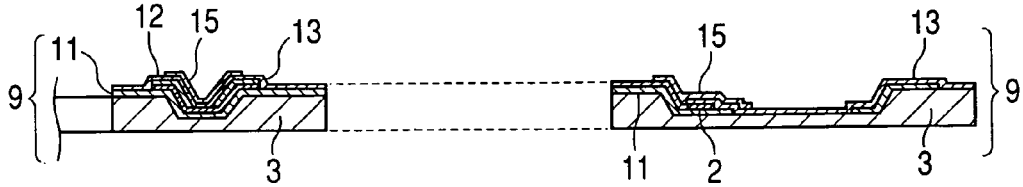

Then, as shown in FIG. 2D, a silicon nitride film is film-formed on the heating layer 11 by using a CVD device and the like thereby to form a protective layer 13. A thickness of the protective layer 13 is selected to 0.3 μm. Then, an anti-cavitation layer 15 for preventing damage of the heating layer 11 is formed on the protective layer 13. The anti-cavitation layer 15 is made of tantalum. A thickness of the anti-cavitation layer 15 is selected to 0.23 μm. Hereinbelow, if necessary, the silicon substrate 3 formed in this way is also referred to as a base plate 9.

Figure 2E:
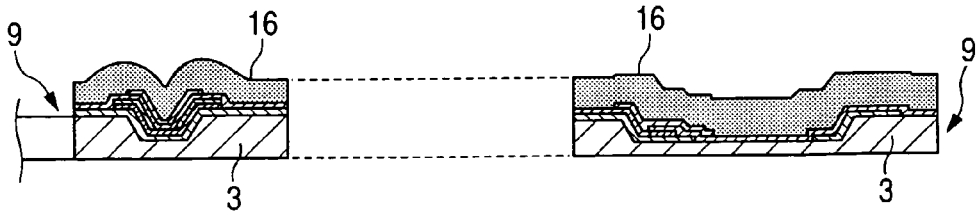
Figure 2F:
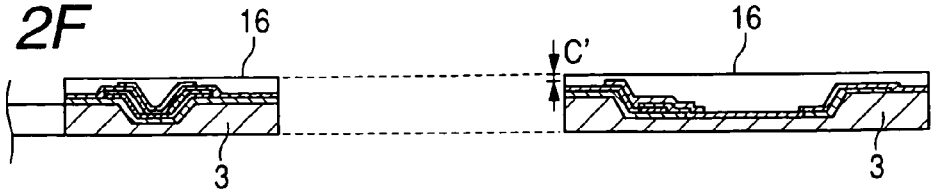

Then, as shown in FIG. 2E, an aluminium film is film-formed on the anti-cavitation layer 15 by using a sputtering device and the like thereby to form a pattern layer 16. A thickness of the pattern layer 16 is selected to 6 μm. Here, since the pattern layer 16 is formed along a stepped configuration of the surface of the base plate 9, the formed pattern layer 16 is subjected to flattening processing thereby to flatten the pattern layer 16, as shown in FIG. 2F. In the illustrated embodiment, the pattern layer 16 is flattened by scraping the surface of the pattern layer 16 by using a slurry including aluminium powder having a fine particle diameter. More specifically, the surface of the pattern layer 16 is scraped until the thickness of the pattern layer 16 becomes 1 μm or less.

Figure 2G:
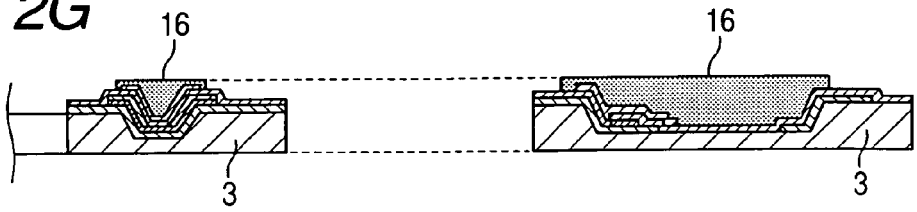
Figure 2H:
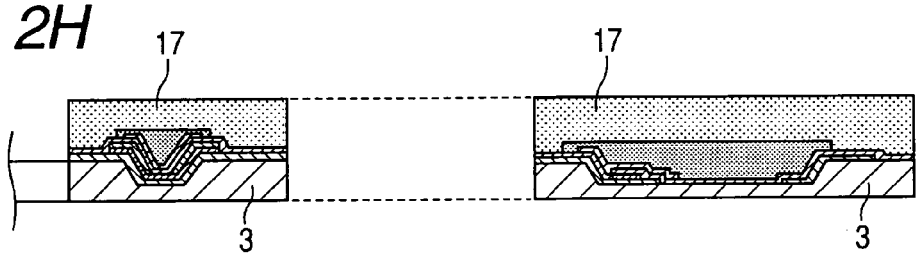

Then, as shown in FIG. 2G, the flattened pattern layer 16 is patterned in accordance with a desired flow path configuration. Thereafter, as shown in FIG. 2H, a silicon oxide film is film-formed on the patterned pattern layer 16 to form a nozzle plate layer 17 which ultimately becomes the nozzle plate 6 shown in FIG. 1. Here, the steps on the surface of the base plate 9 become smaller in comparison with conventional ones by the flattening of the pattern layer 16. Accordingly, a thickness of the nozzle plate layer 17 may be made smaller so long as the height of the discharge port 7 (FIG. 1) can be maintained. Thus, the thickness of the nozzle plate layer 17 is enough in the order of 3 μm to 6 μm, and, in the illustrated embodiment, the thickness is selected to 5 μm.

Figure 2I:
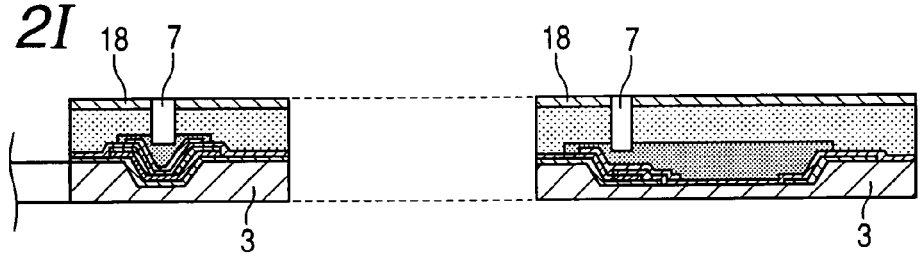

Then, as shown in FIG. 2I, a water-repellant layer 18 is formed on the nozzle plate layer 17 and, thereafter, a mask is formed on a surface of the water-repellant layer 18 and the discharge ports 7 are formed by dry etching.

Figure 2J:
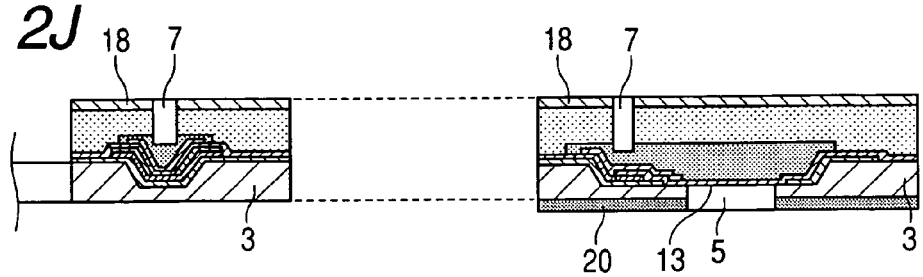

Then, as shown in FIG. 2J, a mask 20 is formed on the back surface of the silicon substrate 3 and the ink supply port 5 is formed by etching. Here, the etching may be wet etching or dry etching, but, it is desirable to protect the water-repellant layer 18 by some means.

Figure 2K:
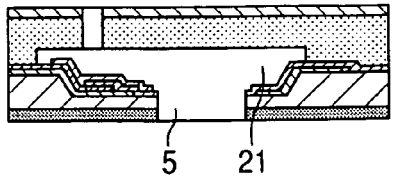

Then, as shown in FIG. 2K, the protective layer 13 (FIG. 2J) acting as an etching stop layer during the formation of the ink supply port 5 is removed by using a dry etching device such as CDE and the mask 20 (FIG. 2J) is also removed. Thereafter, the assembly is immersed into strong alkali solution to remove the pattern layer 16 completely, thereby completing the flow paths.

Thereafter, the silicon substrate 3 on which the nozzle plate 6 is formed is cut and separated by a dicing saw and the like to form chips, and electrical jointing required for driving the heat generating resistant members 2 is performed. Thereafter, a chip tank for supplying the ink is connected. In this way, main manufacturing steps for the recording head 1 are completed.

Figure 3:
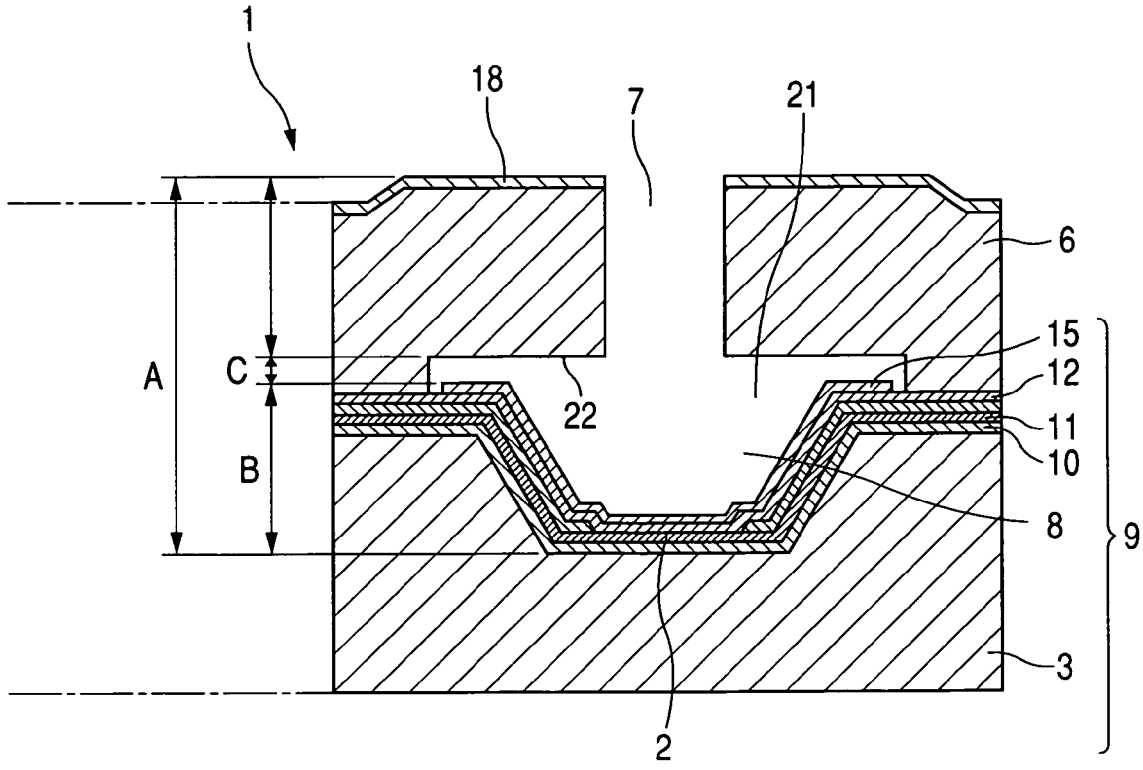
FIG. 3 is a partial sectional view showing a sectional structure of the liquid discharge recording head of FIG. 1.
Figure 4A:
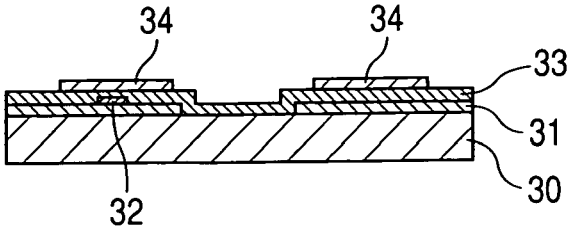
FIGS. 4A, 4B, 4C, 4D, 4E and 4F are partial sectional views showing manufacturing steps for a conventional liquid discharge recording head.
Figure 4B:
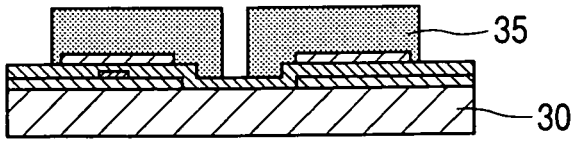
Figure 4C:
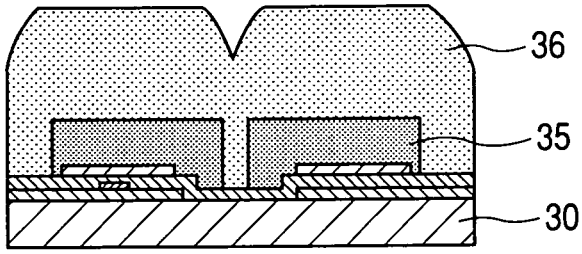
Figure 4D:
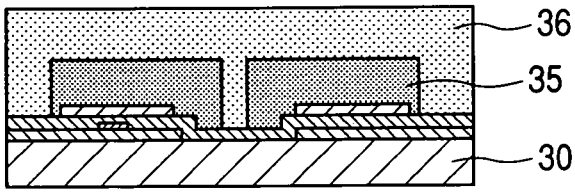
Figure 4E:
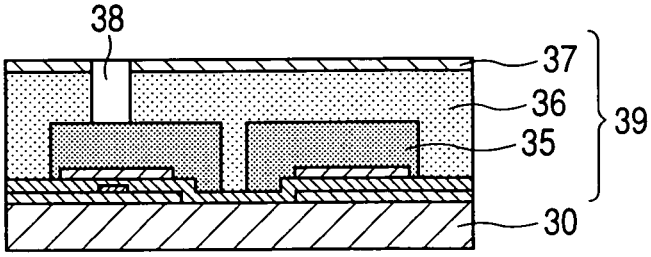
Figure 4F:
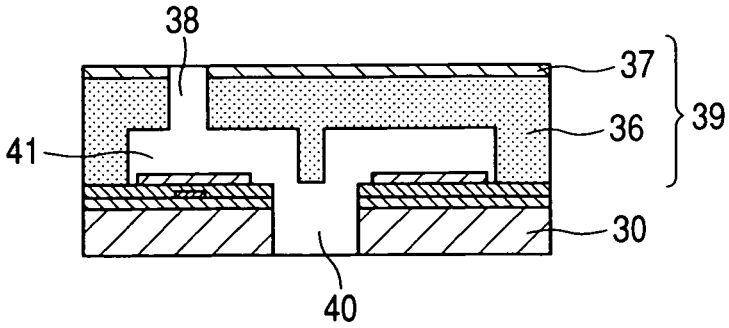

An enlarged section of the recording head 1 completed in this way is shown in FIG. 3. Here, if it is assumed that a distance between the bottom surface of the recessed portion 8 of the base plate 9 and the surface of the water-repellant layer 18 of the nozzle plate 6 is A, a distance between the bottom surface of the recessed portion 8 and the surface of the anti-cavitation layer 15 is B and a distance between the surface of the base plate 9 (the surface of the anti-cavitation layer 15) and a ceiling surface 22 of the flow path 21 is C, relationships $A/2 \leqq B+C$ and $B \geqq C$ are established. Here, during the manufacture of the recording head 1, the distance C between the surface of the base plate 9 and the ceiling surface of the flow path 21 corresponds to a distance C (FIG. 2F) between the surface of the anti-cavitation layer 15 and the surface of the flattened pattern layer 16.

Thus, $A/2 \leqq B+C$ is equivalent to $A/2 \leqq B+C'$ and $B \geqq C$ is equivalent to $B \geqq C'$. Incidentally, although the distance A includes the thickness of the water-repellant layer 18, the water-repellant layer 18 is very thin in comparison with the thickness of the nozzle plate 6. Thus, the distance A substantially equals a distance between the bottom surface of the recessed portion 8 and the surface of the nozzle plate 6. This is also true in a case where a layer other than the water-repellant layer 18 is formed on the surface of the nozzle plate 6.

The recording head according to the present invention can perform the recording on the recording medium such as paper, thread, fiber, cloth, leather, metal, plastic, glass, wood, ceramic and the like. The recording head of the present invention can be applied to printers, copiers, facsimile machines having communication systems, word processors having printer units and industrial recording apparatuses compositely combined with various processing devices, which can perform the recording on such recording media.

This application claims priority from Japanese Patent Application No. 2004-326717 filed on Nov. 10, 2004, which is hereby incorporated by reference herein.

What is claimed is:

1. A liquid discharge recording head including a discharge port for discharging liquid and a flow path for supplying the liquid to the discharge port, comprising:

a silicon substrate including a discharge energy generating element provided in correspondence to the discharge port and adapted to generate energy for discharging the liquid and an electric circuit for driving the discharge energy generating element; and a nozzle plate stacked on a front surface of said silicon substrate and adapted to form a flow path and made of inorganic material, wherein a recessed portion having a predetermined depth is formed in a region of the front surface of said silicone substrate, where said flow path is provided, and said discharge port is formed above said recessed portion, and one or more layers are stacked on or above the discharge energy generating element, and, where a distance between a front surface of an uppermost layer among the one or more layers and a bottom surface of the recessed portion is B, a distance between the bottom surface of the recessed portion and a front surface of said nozzle plate is A and a shortest distance between the front surface of the uppermost layer and a ceiling of the flow path is C, relationships $A/2 \leqq B+C$ and $B \geqq C$ are established.

2. A liquid discharge recording head according to claim 1, wherein the uppermost layer is an anti-cavitation layer for preventing damage of the discharge energy generating element.

3. A liquid discharge recording head according to claim 2, wherein a protective layer formed from a silicon nitride film is formed between the discharge energy generating element and the anti-cavitation layer.

4. A liquid discharge recording head according to claim 2, wherein the anti-cavitation layer is made of tantalum.

5. A liquid discharge recording head according to claim 1, wherein said nozzle plate is formed from a silicon nitride film or a silicon oxide film.

6. A liquid discharge recording head according to claim 1, wherein a heat-resistant layer formed from a silicon oxide film is formed between the bottom surface of the recessed portion and discharge energy generating element.

7. A liquid discharge recording head according to claim 1, wherein the discharge energy generating element is made of tantalum silicon nitride or tantalum chrome.

* * * * *